US005727978A

United States Patent [19]

Alvis et al.

[11] Patent Number: 5,727,978

[45] Date of Patent: Mar. 17, 1998

[54] METHOD OF FORMING ELECTRON BEAM EMITTING TUNGSTEN FILAMENT

[75] Inventors: Roger L. Alvis, Cupertino; Janice Gray, Santa Clara; Bryan Tracy, Oakland, all of Calif.

[73] Assignee: Advanced Micro Devices, Inc., Sunnyvale, Calif.

[21] Appl. No.: 574,480

[22] Filed: Dec. 19, 1995

[51] Int. Cl.[6] ..... H01J 9/02

[52] U.S. Cl. ..... 445/50

[58] Field of Search ..... 445/24, 50

[56] References Cited

U.S. PATENT DOCUMENTS

| | | | |
|---|---|---|---|
| 5,145,435 | 9/1992 | Ayers | 445/50 X |
| 5,227,699 | 7/1993 | Busta | 313/309 X |
| 5,239,863 | 8/1993 | Kado et al. | 250/306 X |
| 5,494,179 | 2/1996 | Hori et al. | 216/11 |

OTHER PUBLICATIONS

L.C. Hopkins et al., "Polycrystalline tungsten and iridium probe tip preparation with a $Ga^+$focused ion beam", Journal of Vacuum Science Technology B 13(2), Mar./Apr. 1995, pp. 335–337.

"Energy Beam Sciences Tungsten Filaments for Electron Microscopes," Energy Beam Science, Inc., Catalog 3, pp. 1 and 3–6.

L.R. Harriott, "Beam–size measurements in focused ion beam systems," Journal of Vacuum Science & Technology A, Second Series, vol. 8, No. 2, Mar./Apr. 1990, pp. 899–901.

*Primary Examiner*—Kenneth J. Ramsey

[57] ABSTRACT

Electron beam emitting filaments having a tip with a radius of curvature less than about 50 Å are produced using focused ion beam milling. In one embodiment, platinum is deposited on a tungsten loop electron beam filament and sharpened using focused ion beam milling to a radius of curvature less than about 50 Å.

8 Claims, 1 Drawing Sheet

METHOD OF FORMING ELECTRON BEAM EMITTING TUNGSTEN FILAMENT

TECHNICAL FIELD

The present invention relates to an electron beam filament having improved brightness, and to a method of manufacturing the electron beam filament.

BACKGROUND ART

Conventional electron beam emitting filaments are produced in several geometric configurations as shown in FIGS. 1A and 1B. The conventional electron beam emitting filament depicted in FIG. 1A comprises arcuate legs 10 terminating at tip 11 and affixed to posts 12 which, in turn, are mounted in base 13. The conventional electron beam emitting filament depicted in FIG. 1B comprises legs 14 forming an acute angle at tip 15 and affixed to posts 16 which, in turn, are mounted in base 17.

Another conventional electron beam emitting filament configuration, which is shown in FIG. 2, comprises a filament 20 forming a loop tip 21. The ends of filament 20 are affixed to base 22. An enlarged tip of loop 21 is shown in FIG. 3, wherein the arrows 30 represent emitted electrons. Electron beam emitting filaments comprising a loop exhibit superior mechanical stability and longevity.

Conventional electron beam emitting filaments are typically produced from tungsten (W) or lanthanum boron ($LaB_6$) and operate by direct electron transmission into free space. Such electron beam emitting filaments enjoy utility and various applications, such as cathode ray tubes, field emission guns and particularly in electron microscopes.

An important characteristic of electron beam emitting filaments is the ability to generate a high degree of brightness and contrast while maintaining mechanical stability for a long operating life. The contrast and brightness of an electron beam emitting filament, as well as its mechanical stability, are dependent upon, inter alia, the geometric configuration of the tip from which the electrons are emitted.

In accordance with conventional practices, electron beam emitting tips are typically fashioned by etching, e.g., chemical or electrochemical etching. Electron beam emitting filaments, including loop filaments, produced in accordance with conventional techniques have tips with a radius of curvature between about 1000 Å and about 5000 Å. Typical electron beam emitting filaments are commercially available from Energy Beam Sciences, Inc., Agawam, Mass. There exists, however, a need for electron beam emitting filaments, particular for use in electron microscopes, which provide a brighter source of electrons than attainable with conventional electron beam emitting filaments, particularly conventional electron beam emitting filaments made from tungsten.

A probe microscope operates in a manner quite unlike an electron microscope. For example, a probe microscope comprises a probe, typically of polycrystalline tungsten and/or iridium, which basically functions as a stylus by tracing various topographies. The geometrical configuration of the tips of such probes is designed to provide access to various topographies which are encountered so that the scan line can actually reflect the depth and the width of a trench as well as the angle of the sidewalls characteristic of the topography undergoing scanning. It has recently been reported that the focused ion beam (FIB) milling has been used to provide a desirable geometric configuration for the tip of a probe for use in a probe microscope. See L. C. Hopkins et al., "Polycrystalline Tungsten and iridium probe tip preparation with a $Ga^+$ focused ion beam," Journal of Vacuum Science Technology B 13(2), March/April 1995, pp. 335–337. Hopkins et al. disclose that FIB milling was employed to produce a probe having a tip with radius of curvature of 5 to 10 nm during a second milling step subsequent to etching. The resulting conical shape, which permits extension of profilometry to high-aspect-ratio features, was considered to be unexpected based upon theoretical calculations. It was further reported that the mechanism that produces the microtips is not known and that further experimentation is warranted.

DISCLOSURE OF THE INVENTION

An object of the present invention is an electron beam emitting filament having a tip with a small radius of curvature and exhibiting a high degree of brightness.

Another object is a method of manufacturing an electron beam emitting filament having a tip with a small radius of curvature exhibiting a high degree of brightness.

Additional objects, advantages and other features of the invention will be set forth in part in the description which follows and in part will become apparent to those having ordinary skill in the art upon examination of the following or may be learned from the practice of the invention. The objects and advantages of the invention may be realized and obtained as particularly pointed out in the appended claims.

According to the present invention, the foregoing and other objects are achieved in part by an electron beam emitting filament having a tip with a radius of curvature less than about 500 Å.

Another aspect of the present invention is the method of manufacturing electron beam emitting filament having a tip, which method comprises sharpening a tip of the electron beam emitting filament with a focused ion beam.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 1A:
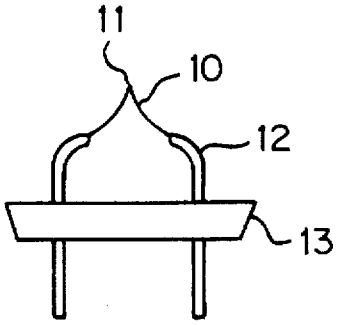
FIG. 1A PRIOR ART
FIGS. 1A, 1B and 2 depict conventional electron beam emitting filament configurations.
Figure 1B:
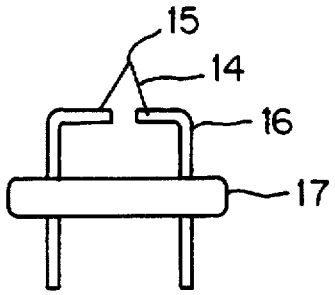
FIG. 1B PRIOR ART
Figure 2:
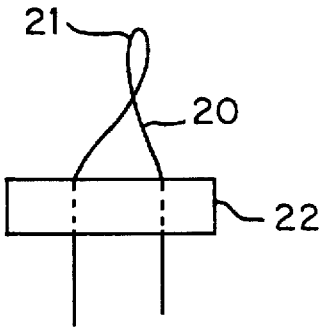
FIG. 2 PRIOR ART
Figure 3:
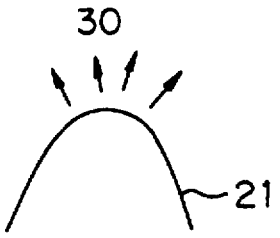
FIG. 3 PRIOR ART
FIG. 3 shows an enlarged portion of a tip of a conventional loop electron beam filament.
Figure 4A:
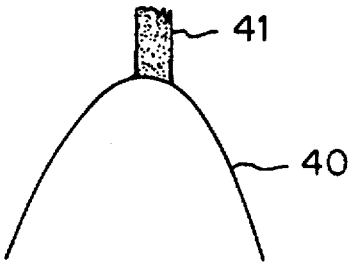
FIGS. 4A and 4B depict sequential steps of an embodiment of the present invention.
Figure 4B:
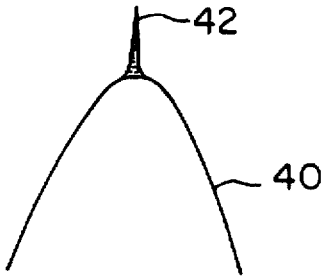

In accordance with the present invention the brightness and the speed at which a high degree of brightness is achieved with an electron beam emitting filament are increased dramatically. The present invention achieves a high degree of brightness and speed by sharpening the tip of an electron beam emitting filament with a focused ion beam (FIB). In accordance with the present invention, the tip of an electron beam emitting filament including a loop filament, preferably comprising tungsten, is sharpened by FIB milling so that it has a radius of curvature less than about 500 Å, preferably less than about 100 Å, most preferably less than about 50 Å. The use of FIB milling in lieu of conventional techniques, such as chemical etching and/or electrochemical polishing, enables the obtainment of an electron beam emitting tip having a radius of curvature over an order of magnitude less than conventional electron beam emitting tips.

Conventional electron beam emitting filaments have a tip through which the electron beam is emitted. Such conventional electron beam emitting tips are produced by chemical etching and/or electrochemical polishing, and typically exhibit a radius of curvature of about 1000 Å to about 5000 Å. In accordance with the present invention, electron beam emitting tips are produced by FIB milling to achieve a radius of curvature over an order of magnitude less than that exhibited by conventionally produced techniques, such as a radius of curvature of less than about 100 Å. Notwithstanding such a small radius of curvature, the electron beam emitting tips produced in accordance with the present invention, including loop tips, exhibit the requisite mechanical stability while providing significantly enhanced contrast and significantly enhanced brightness achievable in a significantly reduced period of time. Moreover, the heat transfer characteristics of the electron beam emitting tips of the present invention are not adversely affected by the small radius of curvature.

FIB milling is an extremely precise type of milling which has heretofore been employed primarily in the semiconductor industry, as in the production of photomasks used in electrophotographic techniques. One having ordinary skill in the art could easily adopt FIB milling technique to achieve the objectives of the present invention by optimizing known conditions and parameters of FIB milling for a particular electron beam emitting filament. For example, the method disclosed by Hopkins et al. can be employed to achieve the objectives of the present invention, employing a liquid-metal ion source generating a 0.16 nA, 20 keV beam of $Ga^+$ ions with a 0.2 μm FWHM spot size. The tip to be sharpened can be irradiated in an annular pattern by cutting an inner and outer radii to produce a desired profile. A typical dose to form a tip is about $1\times10^{19}$ ions/cm$^2$. A measurement of the tip shape is made to determine the radii of the annuluses for end-on cutting. Typically, the inner and outer radii are about 1.5 and 4.5 μm, respectively. Ga implantation during the removal causes the end to appear darker than the surrounding regions during imaging, so that the apex is clearly visible when the tip is turned to face the beam. After the annulus is centered over the apex, cutting is conducted by vector scanning the beam. During the first cut, the dose is not uniform within the annulus. The dose is tapered from the center to the outer diameter of the annulus to minimize milling time as a result of the initial shape of the tips.

In a preferred embodiment, FIB milling is conducted after the tip is initially formed, as by electrochemically etching conducted in a conventional manner, as also disclosed by Hopkins et al. For example, NaOH solution is employed to etch the wire.

The present invention, therefore, comprises a method of producing an electron beam emitting filament, preferably a tungsten filament, by providing a sharpened tip using FIB milling, preferably by a method which comprises initially electrochemically etching followed by FIB milling, to obtain electron beam emitting tips having a dramatically reduced radius of curvature, including less than about 50 Å.

In accordance with another embodiment of the present invention, the tip of a loop type electron beam emitting tungsten filament is modified by a deposition of platinum thereon. Platinum can be deposited by any conventional deposition technique, such as a chemical vapor deposition (CVD) or sputtering technique, preferably by an FIB assisted CVD technique. The deposited platinum is then sharpened in accordance with the present invention using FIB milling to achieve radius of curvature of less than about 500 Å, preferably less than about 100 Å, most preferably less than about 50 Å. In sharpening the deposited platinum by FIB milling, one having ordinary skill in the art can easily adjust the relevant parameters, such as ion dosage and radii of the annuluses, for a particular situation. Thus, the advantages of platinum can be realized using only a small amount of platinum.

In accordance with the present invention, electron beam emitting filaments are produced exhibiting a high degree of mechanical stability, desirable heat transfer characteristics, improved contrast and dramatically increased brightness by providing an electron beam emitting tips having a small radius of curvature sharpened by FIB milling. The electron beam emitting filaments produced in accordance with the present invention enjoy utility in various applications wherein conventional electron beam emitting filaments are employed, particularly in electron microscopes.

Only the preferred embodiment of the invention and example of its versatility are shown and described in the present disclosure. It is to be understood that the invention is capable of use in various other combinations and environments and is capable of changes or modifications within the scope of the inventive concept as expressed herein.

We claim:

1. A method of manufacturing an electron beam emitting filament having a tip, which method comprises: depositing platinum on an electron beam emitting filament; and sharpening the deposited platinum with a focused ion beam to produce the tip.

2. The method according to claim 1, comprising sharpening the tip to a radius of curvature less than about 500 Å.

3. The method according to claim 2, comprising sharpening the tip to a radius of curvature less than about 100 Å.

4. The method according to claim 3, comprising sharpening the tip to a radius of curvature less than about 50 Å.

5. The method according to claim 1, wherein the filament comprises tungsten.

6. The method according to claim 1, wherein the filament comprises a loop.

7. The product produced by the method of claim 1.

8. The product produced by the method of claim 6.

* * * * *